United States Patent [19]

Paultre

[11] Patent Number: 4,917,650

[45] Date of Patent: Apr. 17, 1990

[54] HOOP TYPE TOY

[76] Inventor: Eddy Paultre, 1011 Owasco Rd., West Hempstead, N.Y. 11552

[21] Appl. No.: 241,337

[22] Filed: Sep. 7, 1988

[51] Int. Cl.[4] ..... A63H 33/02

[52] U.S. Cl. ..... 446/453

[58] Field of Search ..... 446/453, 450, 411; D21/101

[56] References Cited

U.S. PATENT DOCUMENTS

| | | | |
|---|---|---|---|
| 217,118 | 7/1879 | Koehl | 446/450 |
| 2,562,522 | 7/1951 | Boyd | 446/453 |
| 3,715,834 | 2/1973 | Gelis | 446/450 |
| 3,785,652 | 1/1974 | Ghovanloo | 446/453 X |

FOREIGN PATENT DOCUMENTS

| | | | |
|---|---|---|---|
| 598838 | 5/1960 | Canada | 446/450 |
| 778845 | 3/1935 | France | 446/450 |

*Primary Examiner*—Mickey Yu

*Attorney, Agent, or Firm*—Bauer & Schaffer

[57] ABSTRACT

Are is disclosed a hoop toy and guide control therefor in which the guide control includes an outwardly curved bifurcated handle which has a removable brake pin thereon as well as control elements which ride only on the external peripheral rim of the hoop or in a central external peripheral groove on the hoop.

7 Claims, 3 Drawing Sheets

10
12
14
16
18
20
22
24
26
28
30
32
34
36
38
40
42
44
46
A
B
C
O 54
56
50
60
70
60
70
62

54
56
58
60
62
60
64

18
30
36
40
20
70

54
56
58
64
60
62
50

HOOP TYPE TOY

BACKGROUND OF THE INVENTION

The present invention relates to a toy and, in particular, to a hoop toy having a guide device for the control thereof.

Hoops have been employed as toys for many years for both children and adults. They provide both fun and a great deal of exercise to the user. The most simple form of such devices is merely a hoop such as a wheel rim or barrel hoop propelled merely by manual manipulation. In lieu of hand operation users have employed sticks to guide the hoop. Over the years a wide variety of hoop toys and guide controls have been developed. Examples of such toys and guide controls are disclosed in U.S. Pat. Nos. 4,453,341; 4,052,814; 3,731,425; 3,715,834; 3,351,889; and sophisticated, none of these devices provide efficient accommodation for high and low speed maneuvering nor provide relative ease in starting and stopping with simplicity of structure.

There exists, therefore, the need for a hook toy and a guide and control therefor which provides such advantages.

The foregoing objects together with other objects and advantages are fulfilled by the present invention as will be apparent from the following disclosure.

BRIEF SUMMARY OF THE INVENTION

In accordance with the present invention there is provided a toy comprising a hoop and a guide control. The guide comprises an elongated handle means having an outwardly curved bifurcated lower portion defined by a pair of legs, joined at their ends by a transverse member. A brake pin is disposed across the legs at a point midway between the handle and the transverse member and which, because of the curvature of the legs, is positioned with the loop itself. The outwardly curved bifurcated lower portion of the guide, the transverse member, and the brake pin cooperating with each other and the hoop to control the direction and the speed of the hoop when the handle is manipulated.

In a preferred form the hoop is provided with grove formed in its perimetal rim and the transverse member at the end of the bifurcation legs is shaped to fit in the groove. Greater control may thus be obtained.

The present invention is more fully disclosed in the following and illustrative in the accompanying drawings.

DESCRIPTION OF THE PREFERRED EMBODIMENTS

Figures 1, 2:
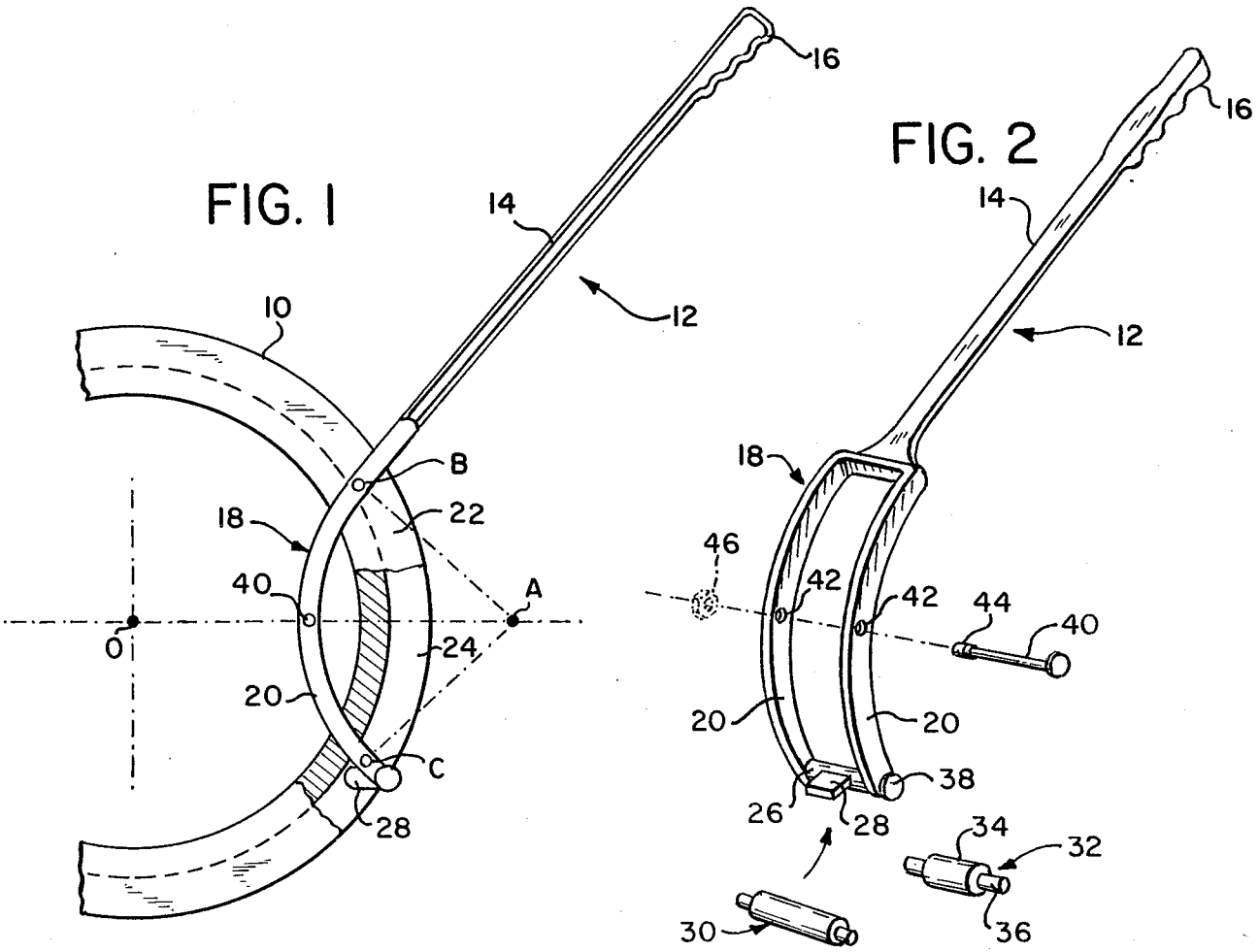
FIG. 1 is a view in elevation and partially in section of a toy constructed in accordance with the invention.
FIG. 2 is a perspective view of the guide control, showing the details of the elongated handle, the outwardly curved bifurcated lower portion, and a number of transverse members adapted to join the lower ends of the legs formed by the bifurcated lower portion as well as the brake pin.

Referring now to FIG. 1, a toy in accordance with the present invention comprises a circular hoop 10 which is provided with a guide control 12. The guide control comprises an elongated handle 14 shaped at its end with a grip 16, by which the user holds the same. Handle 14 extends linearly along an axis and is provided with a curved bifurcated lower portion 18 formed by a pair of legs 20. The bifurcated lower portion 18 is curved so that when the guide means is used, the convex side of the curve crosses the periphery of the hoop at both ends of the bifurcated legs and lays substantially within the interior of the hoop. The rim 22 of the hoop 10 is preferably provided with an external central peripheral groove 24, although it may have a flat peripheral surface, depending upon the construction of elements which rides on such surface, as explained more fully hereinbelow.

As may be seen more particularly from FIG. 2, the free ends of the legs 20 are joined at their lowermost points by a fixed pin 26, provided with a finger 28, which is adapted to project into the exterior peripheral groove 24 in the rim. The remainder of the fixed pin 26 per se rides on the rim 22 of the hoop. In a variation, the fixed pin may be replaced by a cylindrical roller 30 which rides only on the peripheral rim 22 or a modified roller 32 having a large central portion 34 and straddling smaller side portions 36, which are sized so that the central portion 34 rides in groove 24, while the side portions 36 ride on the rim 22. Both rollers 30 and 32 may be constructed similarly to the conventional facial tissue roller in which one of the side pins is axially biased to enable it to be removably held in opposed holes, such as holes 38, formed at the end of the legs 20.

A removable brake pin 40 is disposed across legs 20 at the point somewhere between the lower and upper ends of the legs, preferably in that portion of the curve which would lie in the interior of the hoop. For this purpose, legs 20 are provided with opposed holes 42 into which the brake pin 40 is insertable. Preferably, the holes 42 are internally threaded, and the pin is provided with a fixed head at one end and a short thread 44 at its opposite end which can connect with the internal thread formed in either one or both of the holes 42. Thus, the guide can be placed on the hoop with the curved legs within the interior of the hoop and held there by the pins during use of the toy, yet can be easily withdrawn when desired. Instead of threading the holes 42 knob or nut 46 can be used to secure the pin 40 in place. Other devices such as the swivel end as used to hold bicycle wheels on their hubs, may also be used.

The toy of this invention, including the guide control and the hoop, can be made of light gauge metals such as light weight steel, molded plastics, polypropylenes, polyurethanes, and the like, or various parts of a complete toy can be made from a combination of such materials.

In operation, the guide and hoop are associated or assembled with one another simply by placing the bifurcated legs 20 about the sides of the hoop 10 and inserting the pins 40 into the holes 42 in the legs 20. The hoop 10 is free to roll or move within the legs 20 but is easily propelled by causing the guide roller 26 and the lower portion of the handle 14 to push against the rim 22. The directional movement of the hoop 10 is controlled by the legs 20 in a lateral direction and is aided by the transverse member 26 (or its substitutes 30 or 32) disposed across the lower ends of the legs 20 in both a lateral direction as well as a forward direction. On the other hand, the forward speed of the hoop 10 can be decreased as desired simply by lowering the handle 12 to bring the brake pin 40 into contact with the internal peripheral rim of the hoop 10. The hoop speed can be increased as desired simply by raising the handle 12 so that the brake pin 40 moves away from the inner rim and the hoop moves, being vigorously propelled forward by the legs 20, etc.

In FIGS. 3, 4, 5, and 6 a second embodiment of the toy is illustrated. In this embodiment a hoop 50 of the construction described earlier is provided in combination with a guide control device 52. The control device here is formed of a shaped unitary wire, preferably of flexible steel or the like for greater strength. The device has a grip 54, an elongated handle 56, and a curved bifurcated lower section 58 defined by a pair of legs 60, integrally attached to the handle and closed by an integrally formed transverse member 62. The transverse member 62 is bent at a downward angle from the legs so as to be more or less vertical, and straight and is not provided with any projection or roller portion entering into the peripheral groove of the hoop. Thus, if desired the hoop can be made with a solid smooth rim or tread face, if desired.

Figures 3, 4, 5, 6:
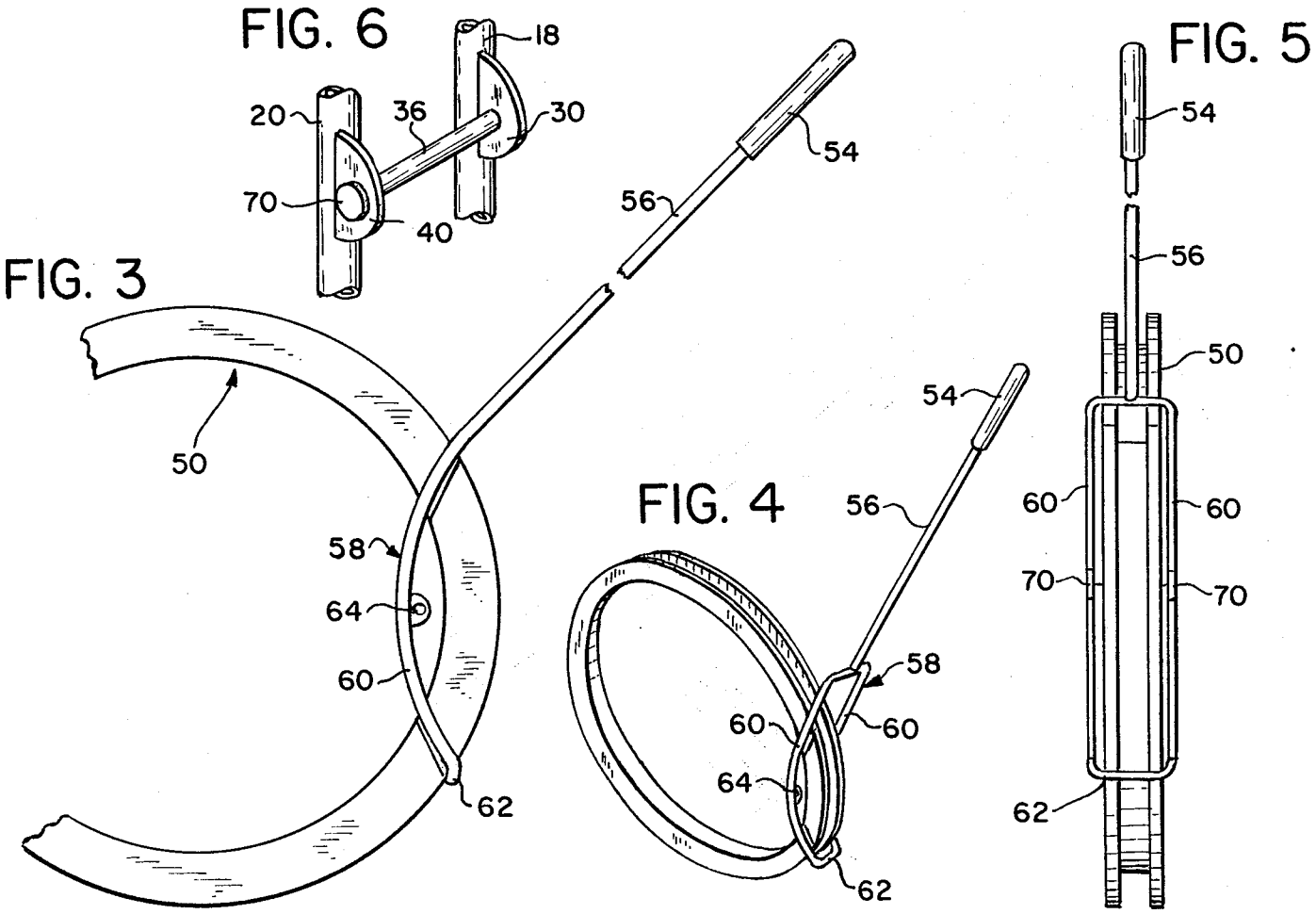
FIG. 3 is an elevational view of another embodiment of the present invention.
FIG. 4 is a perspective view of the toy and guide control therefor shown in FIG. 3.
FIG. 5 is a rear elevational view of the toy and guide control in FIGS. 3 and 4.
FIG. 6 is a perspective view, showing one manner for fixing the brake pin to the legs formed by the outwardly curved bifurcated lower portion of the handle.

A brake pin 64 is provided midway along the legs 60 by integrally disposing on each leg 60, as seen in FIG. 6, a semicircular ear 66 having a hole 68 into which the pin 64 is inserted. As shown earlier, the holes 68 and the pin 64 may be cooperatively threaded; however, in this embodiment it is preferred to employ a small threaded washer shaped nut 70 on the exterior of the ear.

Operation of the combination shown in FIGS. 3, 4, 5, and 6 is generally the same as with the earlier described embodiment, except here the flexibility of the wire guide control device enables swifter response of the hoop and speedier rolling, due to the whip-like propulsion effected. Further, a slightly different control is effected as a result of the absence of a projection fitting into a peripheral groove. The transverse member 62 slides over the rim of the hoop to a somewhat greater extent so that greater skill may be required to provide the necessary control. The vertical dependency of the transverse member 62 also acts as a breaking device when properly placed in contact with the rim.

On the other hand, the transverse member 62 can be bent, if desired, to form a projection such as a V-shaped member or the like, which may, if desired, be used to fit into the peripheral groove of the hoop.

As seen in FIG. 1, the pin 40 is preferably disposed on the legs 20 so that the pin 40, the center 0 of the hoop 10, and the center A of the curvature of the bifuncated leg portion lie on the same line and the distances of the center A and each of the crossing points B and C of the legs 20 with the hoop 10 are equal to the distance between the center A and pin 40. In this manner, excellent control over the hoop is obtained. Other divisions can, of course, be employed.

Further, added speed can be obtained by filling the groove 24 with a ring of heavy material such as metal to provide greater centrifugal force.

Figure 8:
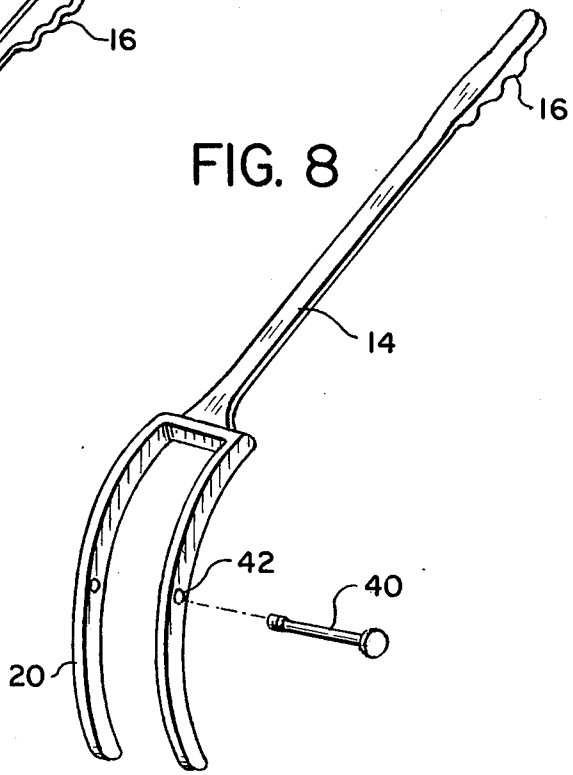
FIG. 8 is a view similar to FIG. 2, illustrating the embodiment shown in FIG. 7.
Figure 7:
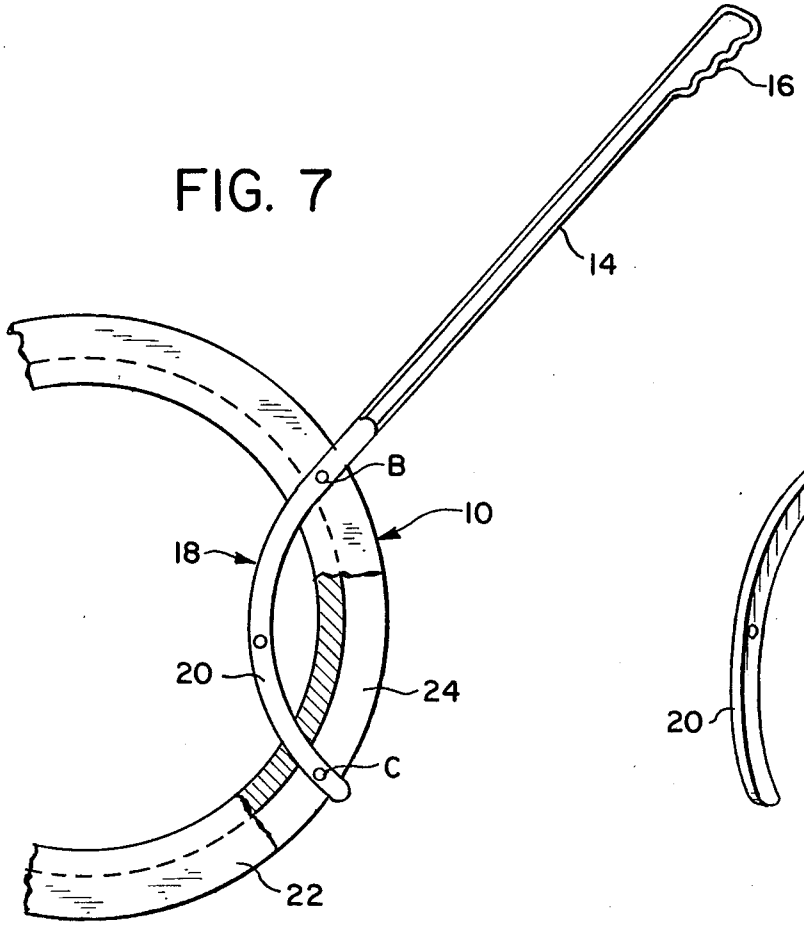
FIG. 7 is a view similar to FIG. 1, illustrating another embodiment of the present invention.

It will be apparent that the guide control device can be effective even without the inclusion of the transverse member 26 or any of its substitute as shown in the preceding embodiment. Thus, taking this into consideration, another embodiment is illustrated in FIGS. 7 and 8. Here a hoop, otherwise constructed as described in connection with FIGS. 1 and 2 is formed without the holes at the extremity of the legs 20 and without the member 26 etc., (although the holes can be made, if desired, to reduce unnecessary manufacturing variations). The legs 20 are sufficiently strong and unbendible, particularly after the brake pin 40 is installed to exert sufficient force on the hoop by their interactions with the hoop at points B and C.

The instant invention presents many advantages. For example, the hoop toy and guidance and control means can be made from a wide variety of readily available and inexpensive materials. Furthermore, due to its simple construction, the toy can be manufactured in a facile manner without the necessity of complex and expensive machinery. Still further, due to its simple construction, it is easy to use while at the same time being effectively guided controlled. Numerous other advantages of the invention will be readily apparent to those skilled in the art.

It is to be understood that this invention is not to be limited to the described detailed embodiments thereof and that many variations of the invention may be made without departing from the spirit and scope of the invention. Therefore, it is to be understood that the invention is not to be limited except as defined in the appended claims.

What is claimed is:

1. A hoop style toy comprising in combination a hoop, the perimeter of which is formed with a continuous groove, and a guide control member comprising an elongated handle having an outwardly arcuately curved bifurcated lower portion formed by a pair of legs joined at one end to said handle by a first transverse member and at their other end by a second transverse member having a projection adapted to ride within said groove, a brake pin secured across said legs at a point substantially midway therealong, said outwardly curved bifurcated lower portion being disposed in use over said hoop so that said brake pin is located in the interior of said hoop, said transverse members ride on the perimeter of said hoop and said legs straddle the hoop crossing the perimeter thereof at two spaced points, said brake pin being disposed on said legs at a point that, when in use on the hoop, said brake pin lies on the line substantially joining the center of the hoop and the center of the curvature of the legs, and the distance between the center of curvature of said legs and the points at which said legs cross the perimeter of said hoop are equal to the distance between the center of curvature and the brake pin so that said transverse members and said brake pin cooperate to provide effective guidance and directional control of said hoop and control of the speed of said hoop when said handle is manipulated to bring said brake pin into control with the inner peripheral rim of said hoop.

2. The toy according to claim 1 wherein the brake pin is removable from said legs so that the guide control can be associated and disassociated with the hoop by removing said brake pin.

3. The toy according to claim 2 wherein said brake pin is a roller.

4. The toy according to claim 1 wherein said second transverse member is removably attached to said legs.

5. The toy according to claim 1 wherein the second transverse member is a roller including means riding on the external periphery of the rim of the hoop and which turns as said hoop rolls.

6. The toy according to claim 1 wherein the second transverse member is a roller and said projection is provided by a large central portion on said roller.

7. The toy according to claim 1 wherein the second transverse member is integrally formed with said legs.

* * * * *